US005826408A

United States Patent [19]

Ford

[11] Patent Number: 5,826,408

[45] Date of Patent: Oct. 27, 1998

[54] ROTARY FLAP TUCKER FOR A CARTONING MACHINE

[75] Inventor: Colin P. Ford, Woodstock, Ga.

[73] Assignee: Riverwood International Corporation, Atlanta, Ga.

[21] Appl. No.: 853,322

[22] Filed: May 8, 1997

[51] Int. Cl.[6] ..... B65B 7/20

[52] U.S. Cl. ..... 53/491; 53/484; 53/382.3; 493/70; 493/80; 493/162

[58] Field of Search ..... 53/491, 484, 382.2, 53/382.3, 48.1; 493/70, 162, 80, 127

[56] References Cited

U.S. PATENT DOCUMENTS

| | | | |
|---|---|---|---|
| 3,325,968 | 6/1967 | Rumberger | 53/491 |
| 3,751,872 | 8/1973 | Helms | 53/48.1 |
| 4,206,579 | 6/1980 | Woxland | 53/491 |
| 4,435,943 | 3/1984 | Hoyrup | 53/491 |
| 5,115,625 | 5/1992 | Barbulesco et al. | 53/491 |
| 5,379,573 | 1/1995 | Greenwell | 53/491 |

*Primary Examiner*—James F. Coan
*Assistant Examiner*—Gene L. Kim
*Attorney, Agent, or Firm*—Skinner and Associates; Steve McLary

[57] ABSTRACT

A rotary flap tucker comprising a tube sector having a smaller arc length end, a larger arc length end, a longitudinal edge, and an edge which helically advances generally from the small arc length end to the large arc length end. The tube sector has end plates each with an edge contoured to avoid contact with a carton flap as the flap tucker rotates about its center axis which is aligned with the carton travel direction. The leading edge of a flap entering the flap tucker follows the helical edge of the flap tucker as it rotates without contacting the flap for a majority of the rotation. Rotation brings the flap tucker's longitudinal edge in contact with the flap along a majority of the flap's length. Continued rotation plows the majority of the length of the flap simultaneously, thereby preventing the flap from misaligning on the carton when the flap is closed. The outside surface of the rotating flap tucker runs against the closed flap of the advancing carton, preferably along the carton's center line.

21 Claims, 6 Drawing Sheets

ROTARY FLAP TUCKER FOR A CARTONING MACHINE

BACKGROUND OF THE INVENTION

1. Field of the Invention

The present invention pertains generally to packaging machines and methods. More particularly, the invention pertains to a packaging machine having a device for closing flaps on cartons.

2. Background Information

In a typical packaging machine for loading groups of articles, such as bottles or cans, within individual cartons, the cartons are stacked in a collapsed form in a supply hopper at one end of the packaging machine. As articles and cartons are conveyed through the packaging machine, the machine opens the collapsed carton, called a blank, groups and positions articles to be placed in the carton, loads the group of articles in the carton, then closes and seals the carton. The step in this process which is the subject of the present invention is the step of closing the carton.

Most cartons have one or more flaps located on the top, bottom, side(s) and/or end(s), which must be closed, tucked, or folded either before or after an article or group of articles is loaded into it. A device which closes flaps on a carton is generally called a flap tucker.

One type of flap tucker is a stationary angled member or wedge which the flap hits as the cartons pass by it on a conveyor. The angled member acts like a plow hitting the leading edge of the flap and sliding along the flap as the flap is closed. When the leading edge of the flap initially contacts the wedge, the impact imparts a horizontal force on the overall carton structure opposite to the direction of travel. That force can distort the carton and cause the flap ends to not align with the sides of the carton when the flap is closed. If the force is great enough, it may even cause the carton to collapse in upon itself. Also friction between the carton flap and the wedge over the course of contact adds to the horizontal force. This can cause the carton to distort, skew, and fail to achieve an optimally square configuration.

Another problem with the stationary wedge type flap tucker is that there is only point contact between the carton flap and the flap tucker. During the typical high speed packing operation on flimsy cartons, with only point contact by the flap tucker the flap can flex greatly as it closes and may not properly close and align with the carton.

Another type of flap tucker is a wheel that rotates in a horizontal plane aligned with the appropriate carton flap. The outer edge of the wheel has a larger diameter sector and a smaller diameter sector. As the stream of open ended cartons is conveyed past the flap tucker wheel, the small diameter sector of the wheel is adjacent the carton for most of the time that a carton is passing the flap tucker and there is no contact between the carton and the flap tucker. When the larger diameter sector comes around, it contacts the flap of the carton and pushes the flap over. The diameter of the wheel and its rotational speed and direction can be synchronized with the speed of the conveyer carrying the cartons to minimize horizontal friction. Since this type of flap tucker does not contact the leading edge of the flap, it does not cause the horizontal load associated with the stationary plow type flap tucker. However, there is still only point contact between the carton and the rotating wheel which could cause the flap to be distorted as it is folded. Any friction load between the flap tucker and the flap as the flap is closed is still in the direction the cartons travel, which could cause misalignment of the flap as it closes.

These problems which cause flaps to misalign with the carton edges when closed are magnified as the flap width increases. The wider the flap, the less the tolerance for distortion of the carton or flap. The problems are most severe when the carton has one wide flap covering the entire bottom of the carton.

All these problems with flap tuckers are accentuated in the processing of a six-crease carton. A six-crease carton has a crease at each corner and an additional crease down the middle of the front and back sides of the carton. This type of carton typically is used to package bottles in groups of four or six. Often called a basket, it usually has a vertical handle section in the middle aligned with the middle creases, and vertical members which go between each article. The basket does not completely encase the bottles. Because of the middle creases, this carton is more easily skewed than other cartons during the flap closing operation.

Accordingly, it is an object of the invention to provide a flap tucker which closes flaps on a carton without distorting the carton or causing flaps to misalign with the carton edges when the flaps are closed.

It is a further object of the invention to provide a flap tucker which has more than point contact on the flap of a carton as the flap is folded.

BRIEF SUMMARY OF THE INVENTION

The apparatus of the present invention provides a flap tucker comprising a generally tubular member, circumferentially open, having a first end of smaller arc length, a second end of greater arc length, a first edge which advances in a helical manner generally from the first end to generally the second end, and a second edge which is parallel to the center axis of the tubular member and which runs from the first end to the second end.

A first end plate may be located at and attached to the first end of the tubular member and a second end plate is located at and attached to the second end of the tubular member. Each end plate extends normal to the center axis of the tubular member. Each end plate has an outer edge which mates with the inner surface of the tubular member where the end plate is located and a contoured inner edge which is contoured to avoid contact with a flap on a carton as the plates rotate about the center axis of the tubular member.

Each end plate has a shaft that extends outwardly from and normal to it. The axis of both shafts align with the axis of rotation of the tubular member.

A bar of generally round cross section extends from the first end plate to the second end plate along the second edge of the tubular member.

Alternatively, the arc length of the first end may be reduced to zero and the first end plate and shaft eliminated. The bar is also eliminated, and in its place the second edge of the tubular member is rolled inward.

A flap tucker of the present invention operates on a continuous stream of cartons traveling in a generally linear direction. The rotational axis of the flap tucker is positioned generally parallel to the direction of travel of the cartons. The rotational axis is also positioned so that as the flap tucker rotates, the bar or rolled edge contacts a flap of the cartons and pushes the flap closed during a predetermined portion of the rotational cycle of the flap tucker. The flap tucker rotates as the cartons advance. The rotation of the flap tucker and travel of the cartons is synchronized so that for a majority of the rotation of the flap tucker, the flap tucker does not contact the flap. The leading edge of a flap entering the flap tucker follows the helical edge of the flap tucker as the flap tucker rotates without contacting it. When contact occurs between the bar and the flap, the contact is along a majority of the flap's length. Because the contact is in a direction primarily normal to the direction the cartons travel, such contact will not significantly distort the carton, even on a six-crease carton.

After the flap is closed, the flap will ride on the outside surface of the flap tucker as it rotates while the carton continues to travel in its generally linear direction. This contact is aligned with the center line of the carton so that such contact will not distort the carton before the glue on the closed flap sets, and offers compression to assist the gluing function.

A dwell cycle may be added whereby the relative motion of the flap tucker and carton is stopped and the flap tucker is raised to apply and hold pressure against the flap while the glue sets.

The features, benefits and objects of this invention will become clear to those skilled in the art by reference to the following description, claims and drawings.

DETAILED DESCRIPTION

Figure 2:
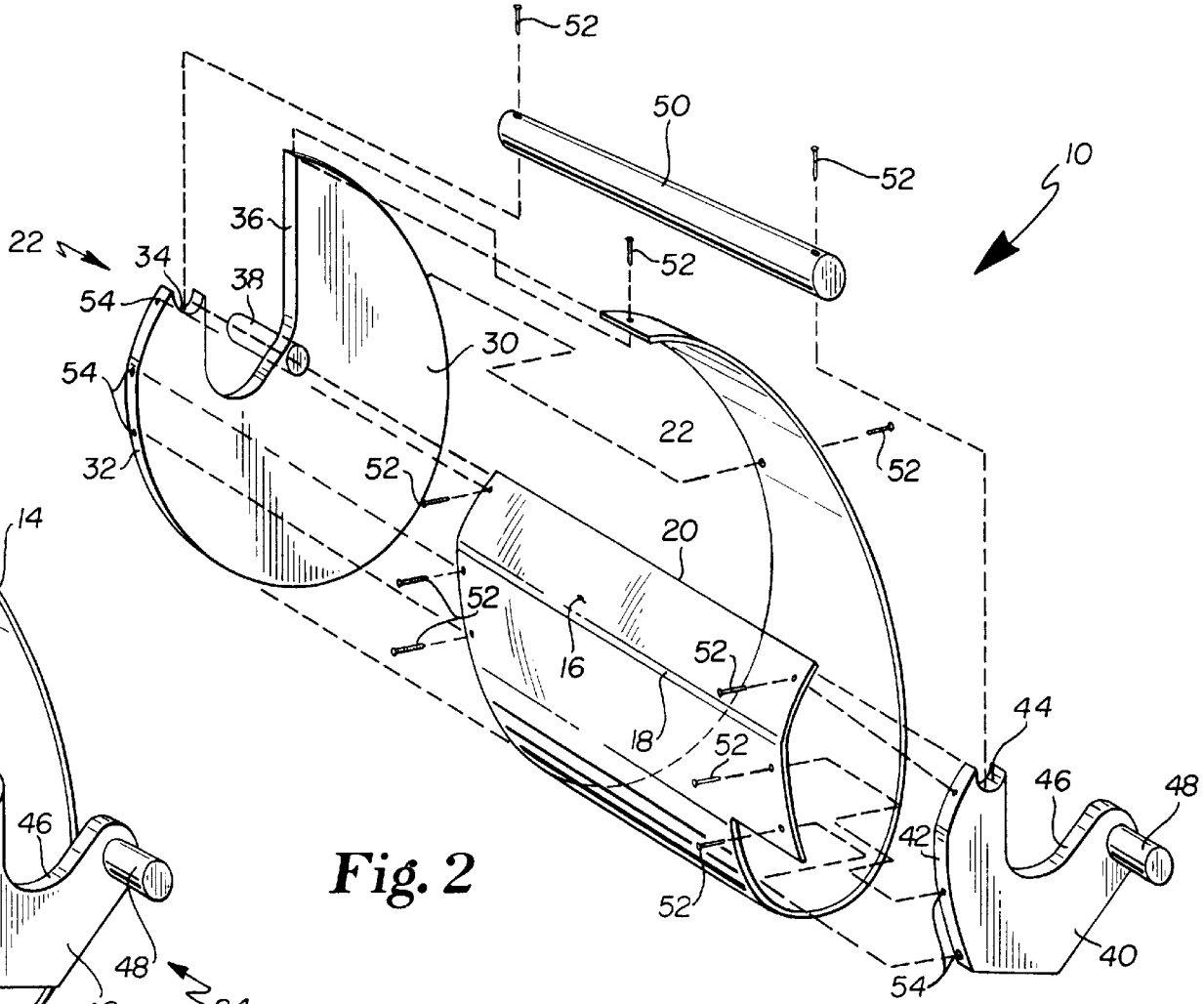
FIG. 2 is an exploded view of the flap tucker of FIG. 1.

Referring to the drawings, wherein like reference numerals designate like or similar elements throughout, one embodiment of the flap tucker 10 is illustrated in FIGS. 1 through 4.

Figure 1:
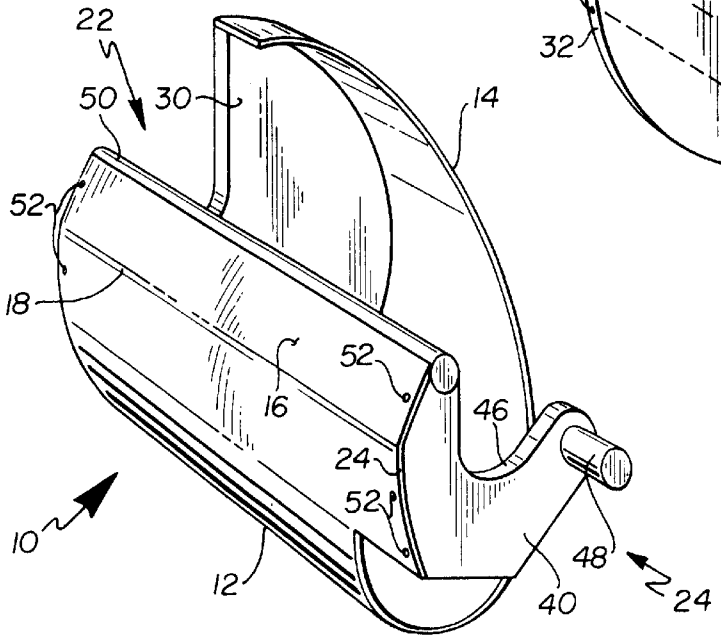
FIG. 1 is a perspective view of one embodiment of the flap tucker of the present invention.

Referring to FIG. 1, the flap tucker 10 comprises a tubular body member 12 which extends for approximately 290° of a circle, drive plate 30, idler plate 40, and bar 50. Tubular member 12 has a tracking edge 14, a bent section 16 which is bent inward at bend line 18, a discharge end 22, and an infeed end 24. Tracking edge 14 is defined in Table 1 which lists the axial coordinates of tracking edge 14 at specific angular locations. The axial number is the distance in inches from an idler plate 40. Angular location is from a timing mark which corresponds with bend line 18.

TABLE 1

| Angular | Axial |
|---|---|
| 30° | 2.42 |
| 40° | 2.77 |
| 50° | 3.12 |
| 60° | 3.47 |
| 70° | 3.81 |
| 80° | 4.16 |

TABLE 1-continued

| Angular | Axial |
|---|---|
| 90° | 4.51 |
| 100° | 4.85 |
| 110° | 5.20 |
| 120° | 5.55 |
| 130° | 5.90 |
| 140° | 6.24 |
| 150° | 6.59 |
| 160° | 6.94 |
| 170° | 7.28 |
| 180° | 7.63 |
| 190° | 7.98 |
| 200° | 8.33 |
| 210° | 8.67 |
| 220° | 9.02 |
| 230° | 9.37 |
| 240° | 9.72 |
| 250° | 10.06 |
| 260° | 10.41 |

Referring to FIG. 2, an exploded view of the components of flap tucker 10 is shown. Tubular member 12 has an outside radius of 6⅜ inches and is constructed of sheet metal approximately 5/32 inches. Bent section 16 maintains the same radius of curvature as the rest of tubular member 12, but the center of that radius is moved due to the bend. Bent section 16 is formed by bending inward approximately 28 degrees the approximately 2-inch wide section of tubular member 12 between bend line 18 and edge 20. Edge 20 of tubular member 12 is beveled to mate with bar 50.

Drive plate 30 is preferably constructed of ½ inch thick metal plate. It has an outer edge 32 which matches the inside contour of tubular member 12 at discharge end 22. A circular notch 34 in drive plate 30 accepts bar 50. Drive plate 30 has an inner edge 36 which allows a flap of a carton (not shown) to pass through the space bounded by edge 36 while flap tucker 10 is rotating until the rotation of flap tucker 10 brings bar 50 into contact with the flap of the carton. Drive shaft 38 is fixedly attached to drive plate 30 and mates with a drive device such as sprocket 31 shown in FIG. 3.

Idler plate 40 is also preferably constructed of ½ inch thick metal plate. It has an outer edge 42 which matches the inside contour of tubular member 12 at in feed end 24. A circular notch 44 in idler plate 40 accepts bar 50. Idler plate 40 has an inner edge 46 which allows a flap of a carton (not shown) to pass through the space bounded by edge 46 while flap tucker 10 is rotating until the rotation of flap tucker 10 brings bar 50 into contact with the flap of the carton. Idler shaft 48 fits in a hole in an idler support 45 in FIG. 3.

Bar 50 fits in circular notches 34 and 44 on drive plate 30 and idler plate 40 respectively and is fixedly attached to drive plate 30 and idler plate 40 at those locations.

Tubular member 12, drive plate 30, idler plate 40, and bar 50 are preferably assembled using screws 52 which threadably engage holes 54 in drive plate 30 and idler plate 40. Alternative means of fastening, such as riveting, welding, soldering or bonding may also be used.

A flap tucker of the present invention can be used to close flaps on the bottom, top, ends or sides of cartons on any packaging machine which folds flaps on a carton. It is most useful on a packaging machine for packaging beverage bottles in basket-like cartons. That application is the subject of the following description and illustrations.

Figure 3:
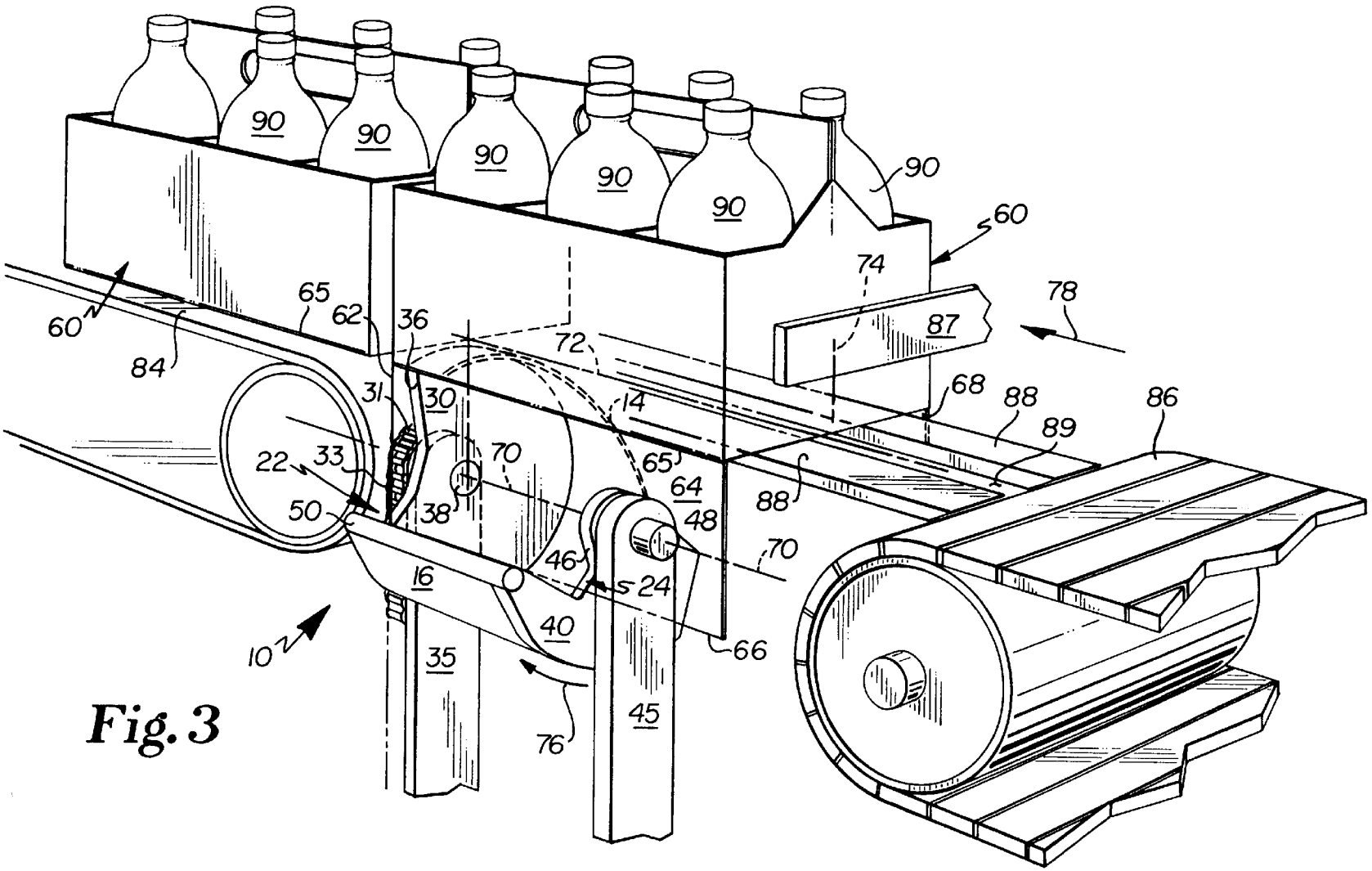
FIG. 3 is a view of the flap tucker of FIG. 1 relative to a stream of moving, loaded six-crease cartons before the flap tucker closes a bottom flap or floor on one carton.

Referring to FIG. 3, flap tucker 10 is shown as used to close a large flap 64 on the bottom of six-crease cartons 60 for bottles 90. A packaging machine (not shown) groups bottles typically in groups of four, six, or eight on a conveyor 86 for moving bottles. A placer mechanism (not shown) places open cartons 60 over a groups of bottles 90 leaving the major bottom flap 64 and minor bottom flap 68 open. Major flap 64 will be folded inward along fold line 65. Minor flap 68 can be folded in a similar manner as flap 64. Cartons 60 can be six-crease cartons such as those illustrated or four crease cartons. The loaded cartons continue to move on the conveyor 86. As a loaded carton 60 approaches the flap tucker 10, the loaded carton 60 slides off of conveyor 86 and onto a dead plate 88. A means for moving loaded cartons 60 on deadplate 88 pushes loaded carton 60 at the proper speed past flap tucker 10. The means for moving loaded cartons on deadplates are well known. A device (not shown) may engage loaded carton 60 from above, or a device, such as lug 87 on a chain (not shown), may engage loaded carton 60 from below. For the latter, deadplate 88 may have a slot 89 to allow lug 87 to protrude through slot 89. Dead plate 88 is cantilevered so that after flaps 64 and 68 are closed around deadplate 88, the loaded carton 60 with closed flaps can be slid off of deadplate 88 and onto conveyor 84.

The flap tucker 10 rotates about an axis 70 which is parallel to the direction the loaded cartons 60 travel indicated by arrow 78. Axis 70 may be in line with the center plane of cartons 60 formed by horizontal centerline 72 and vertical centerline 74 of cartons 60 and approximately at the same vertical level as the lower edge 66 of flap 64. A rotating means, such as sprocket 31 and chain 33 rotate flap tucker 10 in the direction indicated by arrow 76 as cartons 60 travel in the direction indicated by arrow 78. The angular position and rotational speed of flap tucker 10 is synchronized by chain 33 with the means to push loaded cartons on deadplate 88 so that flap tucker 10 rotates one turn for each carton 60, and bar 50 engages flap 64 along most of the length of flap 64.

As flap tucker 10 rotates and cartons 60 with bottles 90 advance in the directions indicated by arrows 76 and 78 respectively, tracking edge 14 of flap tucker 10 provides the means by which the front edge 62 of flap 64 can move through the flap tucker 10 without contacting it. Tracking edge 14 tends to track edge 62 of flap 64 somewhat like a screw as flap tucker 10 rotates and cartons 60 advance. Flap tucker 10 rotates approximately 270° without contacting flap 64 as flap 64 of carton 60 is moving into position.

Figure 4:
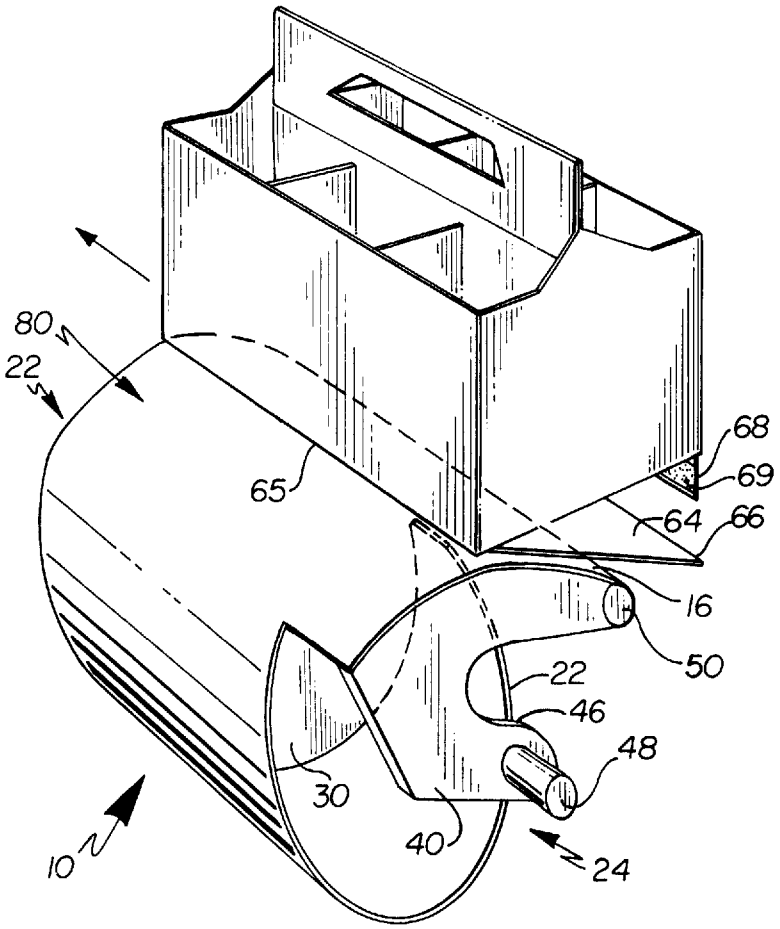
FIG. 4 is a view of the flap tucker of FIG. 1 relative to a carton which is having its flap closed by the flap tucker.

Referring to FIGS. 3 and 4, at approximately 270° rotation, bar 50 of flap tucker 10 has contacted flap 64 of carton 60. Flap 64 is folded at fold line 65 and closed by the rotation of flap tucker 10 from 270° through 360°, at which point the cycle repeats on another carton. FIG. 4 shows the position of flap tucker 10 and carton 60 at approximately the 320° position for flap tucker 10, with flap 64 more than half closed. As flap tucker 10 continues to rotate, closed flap 64 rides on outside surface 80 of flap tucker 10 which keeps flap 64 in a closed position. Flap 68, which may have adhesive 69 applied to it, can then be closed in a similar manner as flap 64 to overlap edge 66 of flap 64, thereby closing the bottom of carton 60. A flap tucker similar to flap tucker 10 but having a smaller diameter can be used to close flap 68. That flap tucker would be synchronized with flap tucker 10 and the means for pushing loaded cartons 60 so that flap 68 is closed after flap 64 is closed.

Since the rotational motion of flap tucker 10 causes bar 50 to contact flap 64 in a direction primarily normal to the axis of motion of cartons 60, the force imparted on carton 60 from flap tucker 10 during closing of flap 64 is primarily normal to the travel direction 78 of the cartons and, therefore, does not distort the six-crease carton enough to cause the edge 62 of flap 64 to be misaligned with the ends of the carton 60. While there is some frictional load in the travel direction of carton 60 because carton 60 is moving while flap 64 is being closed, this load is so small and the flap closure is so fast with respect to the axial motion of carton 60 that carton distortion is not a problem. Even if carton distortion from this axial load were to become a problem, it could be easily remedied by adding reciprocating axial motion to the flap tucker 10 which would be synchronized with the travel of cartons 60 so that there would be no relative motion in the direction of travel between carton 60 and flap tucker 10 during the 90° rotation of flap tucker 10 which closes flap 64.

Rather than having point contact with flap 64, bar 50 contacts flap 64 along the majority of the length of flap 64. This prevents flap 50 from flexing longitudinally as it closes, thereby minimizing distortion of the flap and any associated misalignment.

The rotational axis 70 of flap tucker 10 is preferably in line with the centerline 72 of carton 60 so no distortional load is created by the axial friction of closed flap 64 riding on the outside surface 80 of flap tucker 10 as carton 60 progresses down the line. However, flap tucker 10 may be offset laterally from centerline 72 of carton 60, such as to close a narrow flap like flap 68.

Figure 5A:
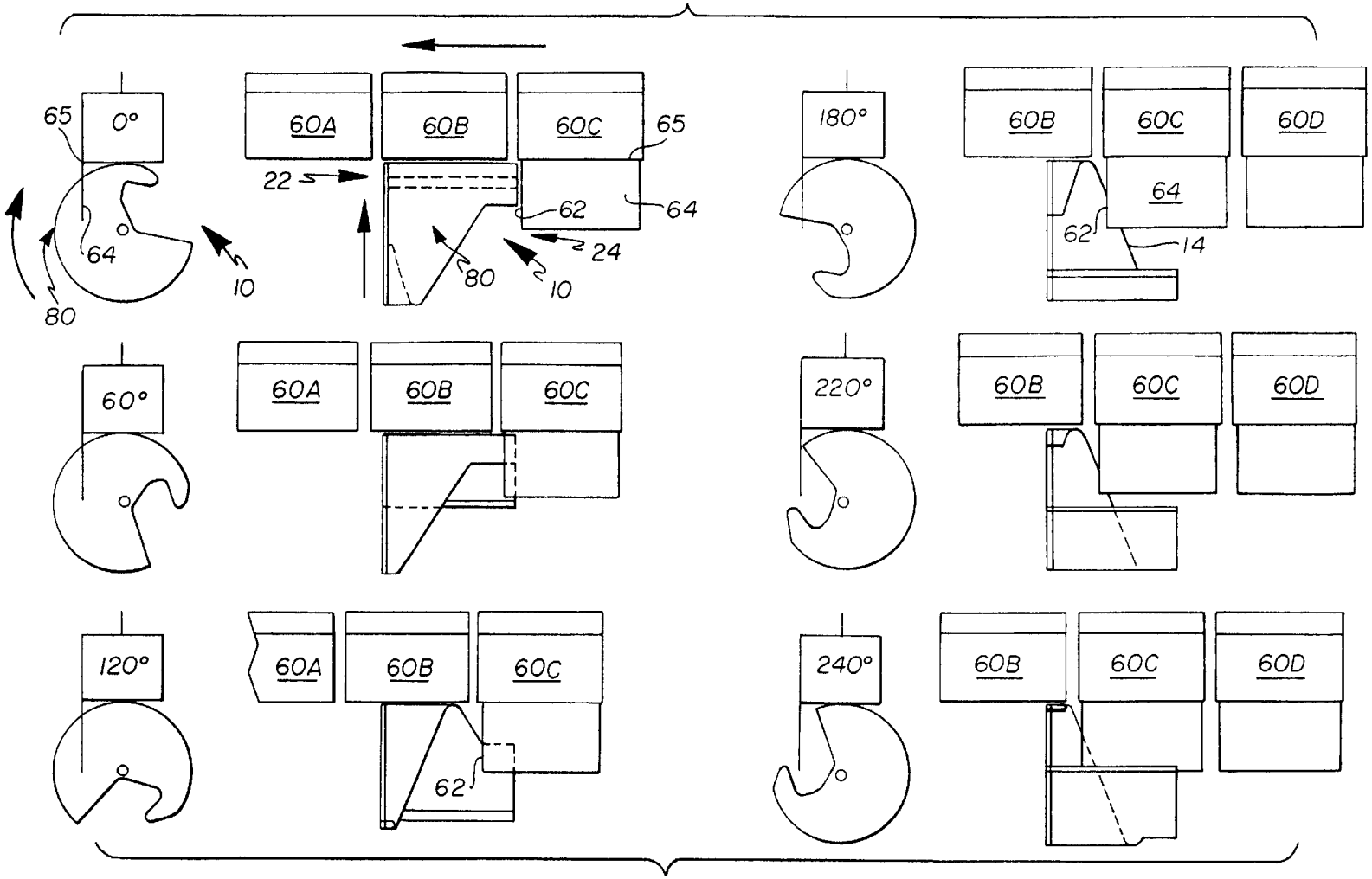
FIGS. 5A and 5B illustrate the relative positions of the flap tucker of FIG. 1 and a portion of a stream of cartons on which it acts through one 360° rotation cycle of the flap tucker.
Figure 5B:
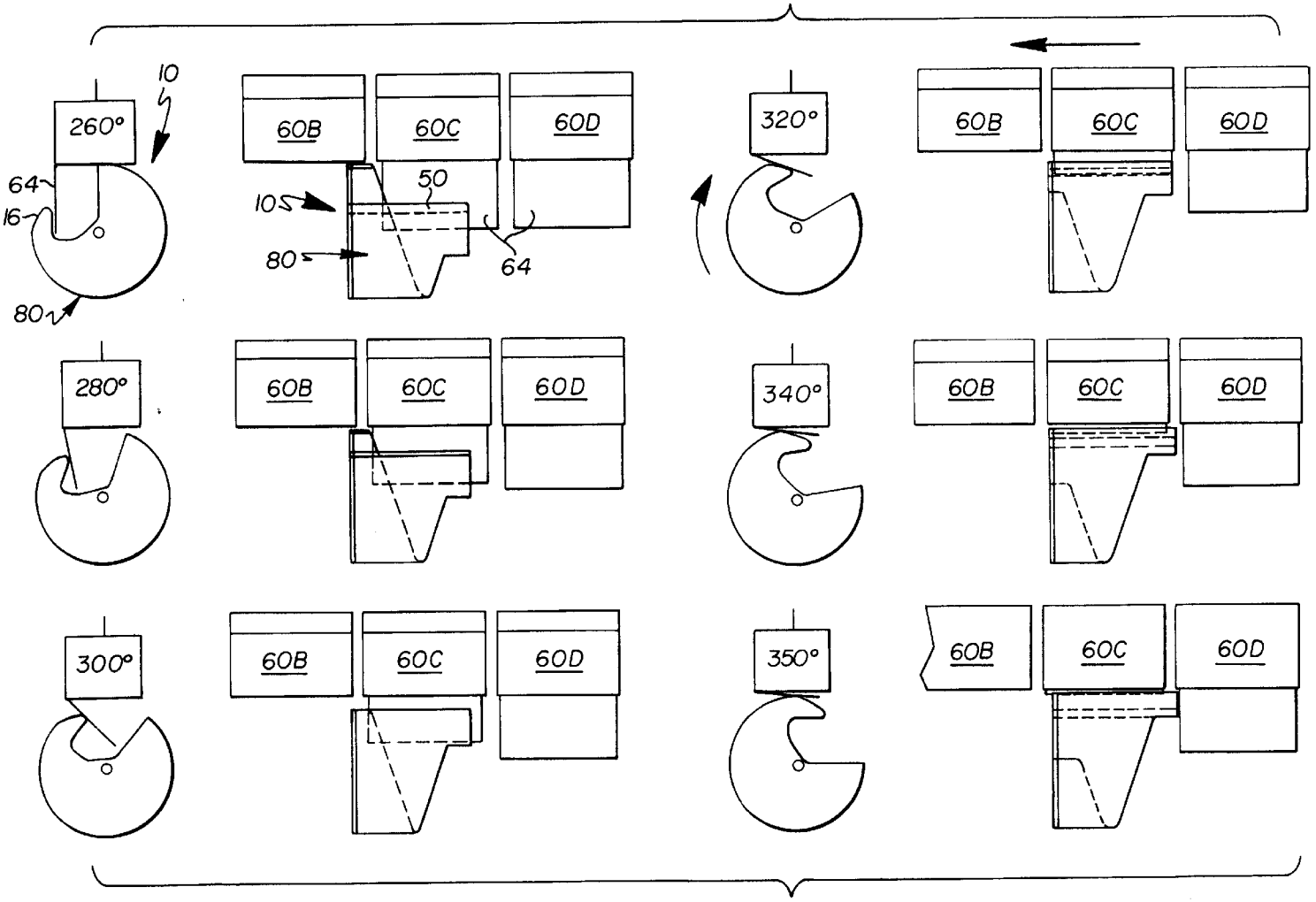

Referring to FIGS. 5A and 5B, the relative rotational position of flap tucker 10 and axial position of cartons 60 is illustrated at various points in a 360° cycle of flap tucker 10 as it closes major flap 64 on cartons 60. An end view of flap tucker 10 and the cartons is on the left of each figure and a side view is to the right. The end view relates to carton 60C.

Referring to FIG. 5A, at the 0° position the cycle on carton 60A has been completed and that carton is leaving the discharge end 22 of flap tucker 10. Carton 60B has had its flap closed and is riding on the outer surface 80 of flap tucker 10. Edge 62 of open flap 64 of carton 60C is just entering the infeed end 24 of flap tucker 10.

As flap tucker 10 continues to rotate through 260° of rotation, and cartons 60 advance, carton 60B continues to ride on the outside surface 80 of flap tucker 10 to hold its flap in a closed position. As carton 60C advances, edge 62 of flap 64 tracks close to tracking edge 14 of flap tucker 10 as flap tucker 10 rotates. No contact is made between flap tucker 10 and carton 60C during this portion of the cycle.

Referring to FIG. 5B, at 260° rotation of flap tucker 10, carton 60B has just had its last contact with the outside surface 80 of flap tucker 10. Bar 50 of flap tucker 10 is just about to contact flap 64 of carton 60C.

From the 270° position through the 350° position, bar 50 contacts flap 64 and pushes it closed as flap 64, folding along fold line 65, rides first on bar 50, then on bent section 16 of tubular member 12, and finally on the outside surface 80 as flap tucker 10 completes its cycle.

A similar cycle can occur to close minor flap 68 (FIGS. 3 and 4) on carton 60. This smaller flap typically has adhesive (69 in FIG. 4) applied to its inside surface just prior to closing, and is folded over the outer edge 66 of the larger flap 64. In the case where a carton has two flaps of approximately equal size two flap tuckers of equal size can be used. The one which closes the latter flap may have to be located down stream from the one which closes the first flap.

To further facilitate proper flap sealing, cartons and flap tucker may dwell for a predetermined time at the 0° position. During this dwell time, a flap tucker may move vertically a predetermined distance to increase the pressure on a flap as adhesive sets. At the end of the dwell time flap tucker 10 returns to its normal vertical position to begin the next cycle.

On a flap tucker of the configuration shown in FIGS. 1–4, idler plate 40 and shaft 48 provide support for flap tucker 10 and allow tubular member 12 to be made of relatively thin material, and consequently to have relatively low inertia. The presence of idler plate 40 and shaft 48 on flap tucker 10 requires some circumferential portion tubular member 12 at infeed end 24 be attached to idler plate 40. A flap 64 of an incoming carton 60 must not bump against this portion of tubular member 12 or idler plate 40 during processing, so some gap must be left between cartons 60 to allow this portion of the flap tucker 10 to rotate through the gap without hitting flap 64.

Figure 6:
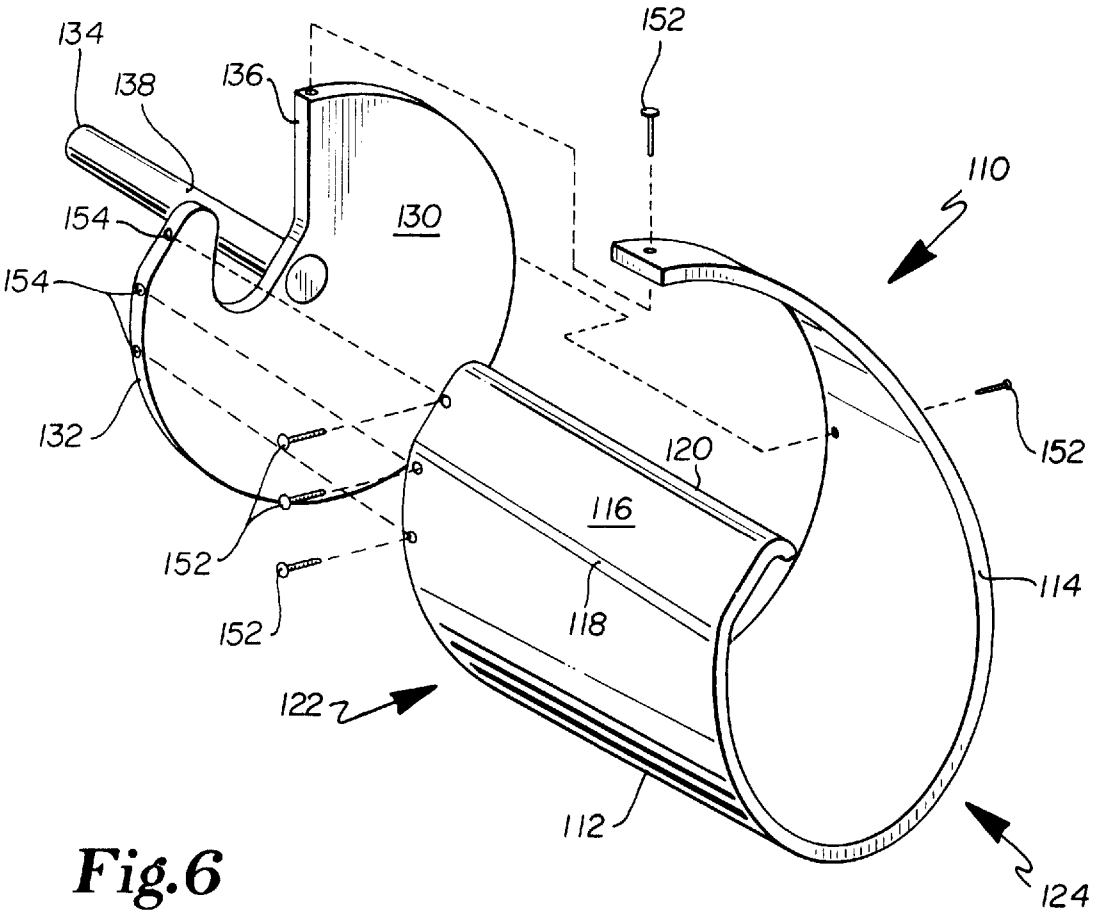
FIG. 6 is a perspective exploded view of another embodiment of the flap tucker.

To minimize the gap required between cartons, an alternate embodiment of the flap tucker 110 as shown in FIG. 6 can be used. Infeed end 124 does not have an idler plate or shaft, and therefore no support device is needed at infeed end 124. Tracking edge 114 of tubular member 112 extends all the way around to rolled edge 120. Drive plate 130 with drive shaft 138 is attached to tubular member 112 at discharge end 122 using screws 152 which threadably engage holes 154 in edge 132 of drive plate 130. Alternative means of fastening, such as riveting, welding, soldering or bonding may also be used. In this embodiment, shaft 138 is long enough to pass through bearings (not shown) which properly support flap tucker 110 cantilevered from those bearings. Shaft 138 would allow for attaching a drive device to it, such as sprocket 31 and chain 33 shown in FIG. 3. As with the previous embodiment, drive plate 130 has an inner edge 136 which allows a flap of a carton (not shown) to pass through the space bounded by edge 136 while flap tucker 110 is rotating until the rotation of flap tucker 110 brings rolled edge 120 into contact with the flap of the carton (not shown).

Because tubular member is only supported at discharge end 122, tubular member 112 must be of sufficient stiffness to be self supporting during operation without undesired deflection and to retain the shape of bent section 116 extending from bend line 118 to rolled edge 120. This can be accomplished by making tubular member 112 of sufficient wall thickness to provide the desired thickness. This thickness is greater than that required for a flap tucker 10 of the configuration shown in FIGS. 1–4, consequently flap tucker 110 may have greater inertia than flap tucker 10. Depending on the maximum pack length to pitch ratio, the drive plate 130 may not need a cut out formed by edge 136, and a smaller diameter flap tucker 110 may be used.

Using a flap tucker 110 of the configuration shown in FIG. 6 will maximize the pitch of the packaging machine (the number of groups of articles processed for a given length of machine) because cartons could be processed with virtually no space between them at the flap closing station. The flap tucker 110 also provides the maximum size range of carton for a fixed envelope of space for closing carton flaps. For these reasons, along with needing a support device at only one end, the flap tucker 110 configuration shown in FIG. 6 is considered the best mode of the invention.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A flap tucker, comprising a generally tubular member, said tubular member having a center axis and a circumferencial wall formed about said center axis, said circumcerential wall having an opening and further having:

(a) an inside surface;

(b) an outside surface (c) a first end of smaller arc length (d) a second end of greater arc length;

(e) a first edge forming a border of said opening in said circumferencial wall said first edge advancing in a generally helical manner about said center axis from said first end to said second end; and (f) a second edge forming a border of said opening in said circumferencial wall, said second edge generally being parallel to said center axis and extending from said first end to said second end.

2. The flap tucker of claim 1, further comprising:

(a) a first end member located at said first end of said tubular member, said first end member extending from said first end to said center axis of said tubular member;

(b) a second end member located at said second end of said tubular member, said second end member extending from said second end to said center axis of said tubular member; and (c) means for fixedly attaching said first end member to said first end of said tubular member and said second end member to said second end of said tubular member.

3. The flap tucker of claim 2, wherein said first and second end members are plates extending normal to said inside surface of said tubular member, said plates having:

(a) an outer edge which mates with said inside surface of said tubular member; and (b) a contoured inner edge contoured to avoid contact with a flap on a carton as said plate rotates about said center axis of said tubular member.

4. The flap tucker of claim 3, further comprising:

(a) a first shaft having a center axis aligned with said center axis of said tubular member, said first shaft extending outward from and normal to said first end plate; and (b) a second shaft having a center axis aligned with said center axis of said tubular member, said second shaft extending outward from and normal to said second end plate.

5. The flap tucker of claim 3, further comprising:

(a) threaded holes in said first end plate and said second end plate, said threaded holes being located on said outside edge of said plates and extending normal to said outside edge;

(b) holes in said tubular member near said first and said second ends located circumferentially to correspond with said threaded holes in said plates; and (c) wherein said means for attaching is screws passing through said holes in said tubular member and threadably engaging said holes in said plates.

6. The flap tucker of claim 2, further comprising a bar extending from said first end member to said second end member along said second edge of said tubular member and wherein a means for attaching fixedly attaches said bar to said first and second end members.

7. The flap tucker of claim 6, wherein said end members further comprise a recess on each of said end members which accepts said bar.

8. The flap tucker of claim 6, wherein:

(a) said bar has a first end, a second end, and at least two apertures through said bar, one aperture being near said first end and another aperture being near said second end, said apertures being parallel to each other;

(b) said first end member and said second end member have threaded apertures aligning with said apertures in said bar; and (c) said means for attaching is screws which pass through said apertures in said bar and threadably engage said threaded apertures in said end members.

9. The flap tucker of claim 6, wherein said bar has a generally round cross section.

10. The flap tucker of claim 9, wherein said second edge of said tubular member is beveled to fit with said round cross section of said bar.

11. The flap tucker of claim 1, wherein said tubular member has a bend, said bend disposing inward a section of said tubular member adjacent said second edge, said second edge thereby being disposed radially inward.

12. The flap tucker of claim 11, wherein said section bent inward extends approximately 20 degrees circumferentially from said second edge of said tubular member and is bent approximately 28 degrees from a line tangent to said tubular member at the location where said bend begins.

13. The flap tucker of claim 1, wherein said arc length of said first end approaches zero, and further comprising:

(a) an end member located at and attached to said second end of said tubular member, said end member extending from said second end to said center axis of said tubular member; and (b) a shaft having a center axis aligned with said center axis of said tubular member, said shaft extending outward from said end member.

14. The flap tucker of claim 13, wherein said end member is a plate extending normal to said inside surface of said tubular member, said plate having:

(a) an outer edge which mates with said inside surface of said tubular member; and (b) a contoured inner edge contoured to avoid contact with a flap on a carton as said plate rotates about said center axis of said tubular member.

15. The flap tucker of claim 13, wherein said second edge is rolled.

16. A method of using a flap tucker of claim 1 to tuck flaps of cartons on a continuous stream of cartons, said cartons traveling in a generally linear direction, said flap tucker having an axis of rotation corresponding to said center axis of said tubular member and further having a rotational cycle, comprising the steps of:

(a) positioning said axis of said tubular member generally parallel to said direction of travel of cartons on which said flap tucker acts;

(b) positioning said axis of said tubular member so that as said flap tucker rotates about said rotational axis, said second edge of said tubular member contacts a flap of a carton and tucks said flap during a predetermined portion of said rotational cycle of said flap tucker;

(c) rotating said flap tucker about said axis while said stream of cartons is moved in a direction generally parallel to said axis of rotation of said flap tucker; and (d) synchronizing said rotational cycle of said flap tucker with said stream of cartons so that for a majority of said rotational cycle, said flap tucker does not contact said flap, and when contact occurs between said flap tucker and said flap, said contact is along a majority of said flap's length.

17. The method of claim 16, further comprising the steps of:

(a) tucking said flap until it is closed; and (b) aligning said axis of rotation vertically so that after said flap is closed, said flap will ride on said outside surface of said flap tucker as said flap tucker rotates and said carton continues to travel in said generally linear direction.

18. The method of claim 16, further comprising the steps of:

(a) dwelling said generally linear movement of said carton with closed flap and said rotation of said flap tucker for a length of time; and (b) during said dwell time, moving said flap tucker vertically a predetermined distance, holding said flap tucker at that location a length of time, and returning said flap tucker to its previous vertical position.

19. A flap tucker for use on a machine for cartoning articles comprising:

(a) a generally tubular member having: a center axis and a circumferencial wall formed about said center axis said circumferencial wall having an opening and further having:

(i) an inside surface:

(ii) an outside surface;

(iii) a first end of smaller arc length;

(iv) a second end of greater arc length;

(v) a first edge forming a border of said opening in said circumferencial wall, said first edge advancing in a generally helical manner about said center axis from said first end to said second end; and (vi) a second edge forming a border of said opening in said circumferencial wall, said second edge generally being parallel to said center axis and extending from said first end to said second end;

(b) an axis of rotation corresponding to said center axis of said tubular member;

(c) a first end member located at said first end of said tubular member, said first end member extending from said first end to said center axis of said tubular member;

(d) a second end member located at said second end of said tubular member, said second end member extending from said second end to said center axis of said tubular member;

(e) means for fixedly attaching said first end member to said first end of said tubular member and said second end member to said second end of said tubular member;

(f) a bar extending from said first end member to said second end member along said second edge of said tubular member; and (g) means for fixedly attaching said bar to said first end member and said second end member.

20. A rotatable flap tucker for use on a machine for cartoning articles comprising:

(a) a generally tubular member having: a center axis and a circumferencial wall formed about said center axis, said circumferencial wall having an opening and further having:

(i) an inside surface;

(ii) an outside surface;

(iii) a first end of smaller arc length;

(iv) a second end of greater arc length;

(v) a first edge forming a border of said opening in said circumferencial wall, said first edge advancing in a generally helical manner about said center axis from said first end to said second end;

(vi) a second edge forming a border of said opening in said circumferencial wall, said second edge generally being parallel to said center axis and extending from said first end to said second end; and (vii) a bend, said bend disposing inward a section of said tubular member adjacent said second edge, said second edge thereby being disposed radially inward; and (b) an axis of rotation corresponding to said center axis of said tubular member;

(c) a first end plate located at said first end of said tubular member and a second end plate located at said second end of said tubular member, wherein both of said end plates extend normal to said inside surface of said tubular member to said center axis of said tubular member, said end plates having an outer edge which mates with said inside surface of said tubular member and said end plates having a contoured inner edge contoured to avoid contact with a flap on a carton as said plate rotates about said center axis of said tubular member;

(d) means for fixedly attaching said first end plate to said first end of said tubular member and said second end plate to said second end of said tubular member;

(e) a first shaft having a center axis aligned with said center axis of said tubular member, said first shaft extending outward from and normal to said first end plate;

(f) a second shaft having a center axis aligned with said center axis of said tubular member, said second shaft extending outward from and normal to said second end plate;

(g) a bar of generally round cross section extending from said first end plate to said second end plate along said second edge of said tubular member; and (h) means for fixedly attaching said bar to said first end member and said second end member.

21. A system for closing flaps on cartons on a machine for cartoning articles comprising:

(a) a plurality of cartons for containing articles, said cartons each having at least one closable flap, said cartons having motion in a generally linear direction;

(b) means for moving said cartons in a generally linear direction;

(c) a flap tucker having a generally tubular member, said tubular member having a center axis and a circumferencial wall formed about said center axis, said circumferencial wall having an opening and further having: an inside surface; an outside surface; a first end of smaller arc length; a second end of greater arc length; a first edge forming a border of said opening in said circumferencial wall, said first edge advancing in a generally helical manner about said center axis from said first end to said second end; a second edge forming a border of said opening in said circumferencial wall, said second edge generally being parallel to said center axis and extending from said first end to said second end; said flap tucker having an axis of rotation corresponding to said center axis of said tubular member; said flap tucker having rotational motion about said axis of rotation, said flap tucker being disposed relative to said cartons such that said second edge contacts and folds an open flap on a carton as said flap tucker rotates and as said cartons move, and said outside surface rides against a folded flap as said cartons move;

(d) means for supporting said flap tucker such that said axis of rotation is generally parallel to direction of motion of said cartons;

(e) means for rotating said flap tucker; and (f) means for synchronizing said rotational motion of said flap tucker with said motion of said cartons such that for a majority of a rotation cycle of said flap tucker said flap tucker does not contact an open flap, and when contact does occur, said contact of said second edge with said open flap occurs over a majority of length of said open flap.

* * * * *